US005970744A

United States Patent [19]

Greeff

[11] Patent Number: 5,970,744

[45] Date of Patent: Oct. 26, 1999

[54] CUT CORNERED SQUARE MIXED-CUT GEMSTONE

[75] Inventor: Robert S. Greeff, Norwalk, Conn.

[73] Assignee: Tiffany and Company, New York, N.Y.

[21] Appl. No.: 09/203,118

[22] Filed: Dec. 1, 1998

[51] Int. Cl.[6] ..... A44C 17/00

[52] U.S. Cl. ..... 63/32

[58] Field of Search ..... 63/32

[56] References Cited

U.S. PATENT DOCUMENTS

| | | | |
|---|---|---|---|
| D. 36,103 | 10/1862 | St. John Wood | 63/32 X |
| D. 250,640 | 12/1978 | Grossbard . | |
| D. 251,659 | 4/1979 | Grossbard . | |
| D. 297,718 | 9/1988 | Cohen et al. . | |
| D. 337,742 | 7/1993 | D'Haene . | |
| D. 338,851 | 8/1993 | D'Haene . | |
| D. 366,628 | 1/1996 | Grossbard . | |
| D. 389,425 | 1/1998 | Rosenberg . | |
| D. 391,518 | 3/1998 | Slowinski et al. . | |
| D. 402,582 | 12/1998 | Ambar . | |
| 712,155 | 10/1902 | Seddon | 63/32 |
| 2,270,270 | 1/1942 | Clare | 63/32 |
| 3,490,250 | 1/1970 | Jones | 63/32 |
| 3,796,065 | 3/1974 | Watermeyer . | |
| 4,020,649 | 5/1977 | Grossbard . | |
| 4,118,949 | 10/1978 | Grossbard . | |
| 4,118,950 | 10/1978 | Grossbard . | |
| 4,555,916 | 12/1985 | Grossbard . | |
| 5,186,024 | 2/1993 | Waters, Jr. | 63/32 |
| 5,657,646 | 8/1997 | Rosenberg . | |

OTHER PUBLICATIONS

Peinarr, H.S., "A New Standard Mixed Cut for Diamonds", Gems and Gemology, Winter, 1971–72.

"New Radiant Cut Dazzles With Fire", The Radiant Cut Diamond Corp., 15 W. 47th St., New York, New York 10036.

Der Barion—Diamantschliff, Dec. 1977, p. 72.

GIA Gem Trade Laboratory Diamond Grading Report No. 0421726 for Cut–Cornered Rectangular Mixed–Cut, dated Jul. 30, 1998.

*Primary Examiner*—Brian K. Green
*Assistant Examiner*—Andrea Chop
*Attorney, Agent, or Firm*—Peter J. Phillips

[57] ABSTRACT

A cut cornered mixed-cut square gemstone comprises a step-cut crown, with two steps and a table, a girdle and a pavilion. The crown and pavilion are substantially square with four equal sides, and corners about ⅓ the length of the sides. The pavilion sides and corners are defined by eight rib lines which extend substantially continuously from the girdle to a culet. Each pavilion side and corner has four facets, including a lower girdle star facet, two lower girdle facets and a lower bezel facet. The gemstone has the classic elegance of a step cut in the crown and attempts to achieve the good dispersion of a brilliant cut in the pavilion.

18 Claims, 7 Drawing Sheets

CUT CORNERED SQUARE MIXED-CUT GEMSTONE

The present invention relates to a square mixed-cut gemstone having cut corners.

Gemstones, especially precious gemstones such as diamonds, emeralds, sapphires and rubies, have various characteristics that distinguish them from other gemstones. One characteristic is brilliance, which can be further categorized into external and internal. External brilliance, also referred to as luster, generally refers to the amount of light that impinges on the top of the stone and reflects back, rather than refracted inward. Internal brilliance is determined by the light rays that enter the top or crown (and table if the gem has one), and reflected off the base or pavilion facets and back out through the top or crown as undispersed light.

Another characteristic of a gemstone is dispersion, also known as fire, which is a measure of how much the white light is broken up into the spectral colors. A ray of white light striking a prism will be split up into special component colors of red, orange, yellow, green, blue, indigo and violet. Dispersion is maximized when a ray of light is reflected totally from base facets and strikes the ground facets at the greatest possible angle. Dispersion is observed when a gemstone moves relative to an observer.

Another characteristic of a gemstone is scintillation, which is an indication of the different light patterns obtained when the stone is moved under light. Expressed in another way, scintillation is the quantity of flashes observed from the gemstone when at least one of the gemstone, light source or observer moves.

Generally, gemstone cutters try to achieve a good combination of brilliance, dispersion and scintillation.

Gemstones may also be classified into different types of cuts. One cut is known as a step cut or emerald cut and is generally considered an elegant and classic cut. However, this cut does not generally achieve the most dispersion.

Another cut is known as a brilliant cut, which in one form is a round brilliant. This cut has many facets and achieves a good balance of brilliance and dispersion.

Yet another cut is a so-called hybrid or mixed-cut, which attempts to achieve the elegant and classic look of a step cut, while also attempting to achieve good dispersion as in a brilliant cut.

The present invention is directed to a mixed-cut gemstone, and includes attributes of both the step cut and brilliant cut types.

SUMMARY OF THE INVENTION

It is an object of the present invention to provide a mixed-cut gemstone having more dispersion than a step cut or emerald cut gemstone.

It is an object of the present invention to provide a mixed-cut gemstone having a substantially square shaped crown which is elegant and classic.

It is an object of the present invention to provide a mixed-cut gemstone having a brilliant cut pavilion which provides good dispersion.

It is an object of the present invention to provide a mixed-cut gemstone having the combination of the elegance and classic appeal of a step cut or emerald cut, with the good dispersion of a brilliant cut.

It is an object of the present invention to provide a mixed-cut gemstone having a substantially square shaped crown and having cut corners.

It is an object of the present invention to provide a mixed-cut gemstone which provides a good balance of very good brilliance, dispersion and scintillation.

It is an object of the present invention to provide a mixed-cut gemstone which provides good brilliance, dispersion and scintillation without a large number of facets on the pavilion.

It is an object of the present invention to provide a mixed-cut gemstone having substantially quadrature symmetry.

It is an object of the present invention to provide a mixed-cut gemstone having a table with a table percentage providing a good balance of brilliance, dispersion and scintillation.

It is an object of the present invention to provide a mixed-cut gemstone having essentially one culet, centrally located at the base of the pavilion, which is a point, line or a planar facet.

It is an object of the present invention to provide a mixed-cut gemstone having a crown and pavilion with matching side and corner portions.

It is an object of the present invention to provide a mixed-cut gemstone having a crown and pavilion with symmetrical side and corner portions.

It is an object of the present invention to provide a mixed-cut gemstone having a pavilion portion with rib lines extending substantially continuously from the girdle to the culet.

It is an object of the present invention to provide a mixed-cut gemstone having a table with a table size that is not too small as to lose brilliance, yet not too large as to lose dispersion.

It is an object of the present invention to provide a mixed-cut gemstone having a crown height which is not too shallow.

It is an object of the present invention to provide a mixed-cut gemstone having a stepped crown having a relatively small number of steps so as to not provide too much dispersion.

According to one aspect of the invention, a cut cornered mixed-cut gemstone is provided, comprising a girdle, a crown above said girdle and a pavilion below said girdle. The crown has a width and length formed by two pairs of opposing crown sides and four crown corners. The crown also comprises at least two steps, including a first step from the girdle to a crown break, and a second step from the crown break to a table break. The crown also has a substantially flat table. The pavilion comprises a substantially centrally located culet at the bottom of the pavilion, and also comprises two pairs of opposing pavilion sides and four pavilion corners defined by eight rib lines extending from the girdle to the culet. Each pavilion side and pavilion corner comprises four facets each having a facet corner intersecting at a facet intersection point. The four facets include a lower girdle star facet having one edge along the girdle, two lower girdle facets adjacent said lower girdle star facet and each having a side along an adjacent rib line, and a lower bezel facet adjacent said two lower girdle facets, with the lower bezel facet having two sides along adjacent rib lines.

According to another aspect of the invention, a cut cornered mixed-cut gemstone is provided, comprising a girdle having a length and width and being in a girdle plane, a crown above said girdle and a pavilion below said girdle. The crown has a width and length formed by two pairs of opposing crown sides and four crown corners. The crown also comprises two steps, including a first step from the girdle to a crown break having an angle of about 41–44 degrees relative to the girdle plane, and a second step from the crown break to a table break having angle of about 36–39 degrees to the girdle plane. The length of the longest crown side along the girdle is about three times the length of a crown corner along the girdle, and the length of the crown along its longest crown side is about 100 to 103% of its width along the shortest crown side. The crown also has a substantially flat table. The table has a size defined by its width, and is about 52–58% of the width of the crown at the girdle. The crown has a total of 17 facets. The pavilion comprises a substantially centrally located culet at the bottom of the pavilion, and also comprises two pairs of opposing pavilion sides and four pavilion corners defined by eight rib lines extending from the girdle to the culet. Each pavilion side and pavilion corner comprises four facets each having a facet corner intersecting at a facet intersection point. The four facets including a lower girdle star facet having one edge along the girdle, two lower girdle facets adjacent said lower girdle star facet and each having a side along an adjacent rib line, and a lower bezel facet adjacent said two lower girdle facets, with the lower bezel facet having two sides along adjacent rib lines. The pavilion has a pavilion length defined by a first pair of two opposed pavilion sides, and a pavilion width defined by a second pair of two opposed pavilion sides adjacent said first pair of opposed pavilion sides, said pavilion length and pavilion width being further defined by respective dimensions along the length and width of the girdle, and wherein the pavilion length is preferably between about 100 and 103% of the pavilion width. The pavilion has a total of 32 facets, exclusive of any culet facet. The gemstone has a total depth of about 65–71% of the width of the girdle.

Other objects and advantages of the present invention will become more apparent from the detailed description of the preferred embodiment, appended claims and attached drawings.

DETAILED DESCRIPTION OF THE PREFERRED EMBODIMENT

Figure 1:
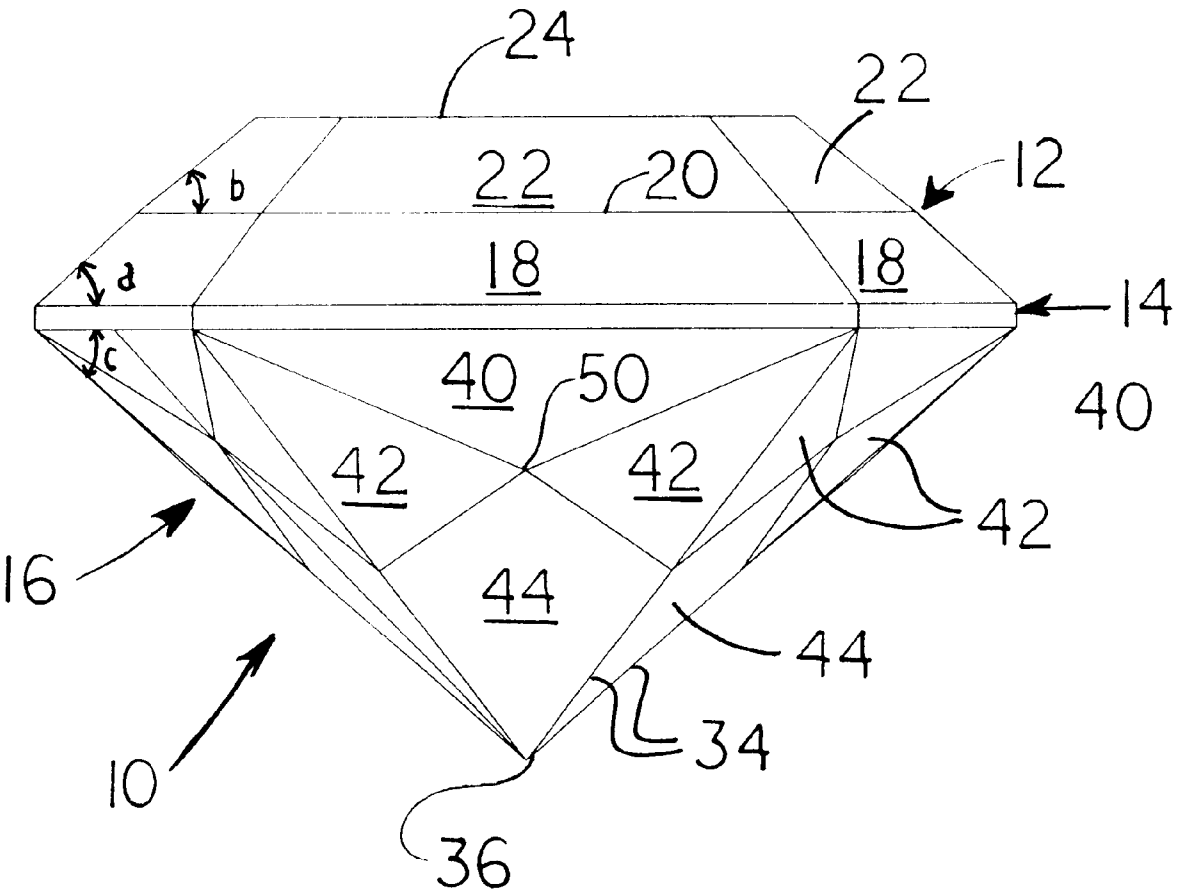
FIG. 1 is a side elevational view of a gemstone in accordance with the present invention.

According to one aspect of the invention, a cut cornered mixed-cut gemstone is provided, comprising a girdle, a crown above said girdle and a pavilion below said girdle. The crown has a width and length formed by two pairs of opposing crown sides and four crown corners. The crown also comprises at least two steps, including a first step from the girdle to a crown break, and a second step from the crown break to a table break. The crown also has a substantially flat table. The pavilion comprises a substantially centrally located culet at the bottom of the pavilion, and also comprises two pairs of opposing pavilion sides and four pavilion corners defined by eight rib lines extending from the girdle to the culet. Each pavilion side and pavilion corner comprises four facets each having a facet corner intersecting at a facet intersection point. The four facets including a lower girdle star facet having one edge along the girdle, two lower girdle facets adjacent said lower girdle star facet and each having a side along an adjacent rib line, and a lower bezel facet adjacent said two lower girdle facets, with the lower bezel facet having two sides along adjacent rib lines.

The length of the crown may be between about 100 to 110% of the width of the crown, and more preferably between about 100 to 103% the width of the crown.

The girdle lies substantially in a girdle plane. The first step of the crown is preferably at an angle of about 41–44 degrees relative to the girdle plane, and the second step is preferably at an angle of about 36–39 degrees relative to the girdle plane.

The crown preferably has 17 facets and the pavilion preferably has 32 facets, exclusive of any culet facet.

The culet may be in the form of a point, a line or a facet.

The length of the crown along the girdle is preferably about three times the length of crown corner along the girdle.

The pavilion has a pavilion length defined by a first pair of two opposed pavilion sides, and a pavilion width defined by a second pair of two opposed pavilion sides adjacent said first pair of opposed pavilion sides. The pavilion length and pavilion width are further defined by respective dimensions along the length and width of the girdle, and the pavilion length is preferably between about 100 and 110% of the pavilion width.

The table has a size defined by its width, and the table size is about 52–58% of the width of the crown at the girdle.

The total depth of the gemstone is preferably about 65–71% of the width of the girdle.

The rib lines in the pavilion are preferably at an angle of about 38–42 degrees relative to the girdle plane.

According to another aspect of the invention, a cut cornered mixed-cut gemstone is provided, comprising a girdle in a girdle plane, a crown above said girdle and a pavilion below said girdle. The crown has a width and length formed by two pairs of opposing crown sides and four crown corners. The crown has two steps, including a first step from the girdle to a crown break having an angle of about 41–44 degrees relative to the girdle plane, and a second step from the crown break to a table break having angle of about 36–39 degrees to the girdle plane. The length of the longest crown side along the girdle is about three times the length of a crown corner along the girdle, and the length of the crown along its longest crown side is about 100 to 103% of its width along the shortest crown side. The crown also has a substantially flat table. The table has a size defined by its width, and is about 52–58% of the width of the crown at the girdle. The crown has a total of 17 facets. The pavilion comprises a substantially centrally located culet at the bottom of the pavilion, and also comprises two pairs of opposing pavilion sides and four pavilion corners defined by eight rib lines extending from the girdle to the culet. Each pavilion side and pavilion corner comprises four facets each having a facet corner intersecting at a facet intersection point. The four facets including a lower girdle star facet having one edge along the girdle, two lower girdle facets adjacent said lower girdle star facet and each having a side along an adjacent rib line, and a lower bezel facet adjacent said two lower girdle facets, with the lower bezel facet having two sides along adjacent rib lines. The pavilion has a pavilion length defined by a first pair of two opposed pavilion sides, and a pavilion width defined by a second pair of two opposed pavilion sides adjacent said first pair of opposed pavilion sides, said pavilion length and pavilion width being further defined by respective dimensions along the length and width of the girdle, and wherein the pavilion length is preferably between about 100 and 103% of the pavilion width. The pavilion has a total of 32 facets, exclusive of any culet facet. The gemstone has a total depth of about 65–71% of the width of the girdle.

Referring to the drawings, FIG. 1 shows a side elevational view of a mixed-cut gemstone 10 according to a preferred embodiment of the present invention. The gemstone 10 has a crown 12, a girdle 14 and a pavilion 16. The crown 12 has two steps, including a first step 18 which starts at the girdle 14 and ends at a crown or middle break 20, and a second step 22 which starts at the crown break 20 and ends at a table 24. The table 24 is substantially flat. Although two steps are preferred, more than two steps may be provided, in which case the steps in excess of two or three may be relatively small.

The girdle 14 extends around the perimeter of the gemstone and may also be called a girdle plane. In the preferred embodiment, the girdle has at least some thickness and defines some facets, but any such thickness is relatively small compared to the sizes of the facets on the crown 12 and pavilion 16. In the preferred embodiment, the girdle thickness is preferably about 1–2.5% of the width of the girdle. In the preferred embodiment, the girdle thickness can also be described as being "very thin" to "slightly thick", terms known and understood to those skilled in the art.

There are two crown angles which may be used to characterize the steps of the crown. Angle a is the crown angle between the girdle plane and the first step 18, and angle b is the crown angle between the second step b and the girdle plane (or a plane parallel to the girdle plane). In the preferred embodiment, crown angle a has a value in the range of about 41–44 degrees, and crown angle b has a value in the range of about 36–39 degrees.

Figure 2:
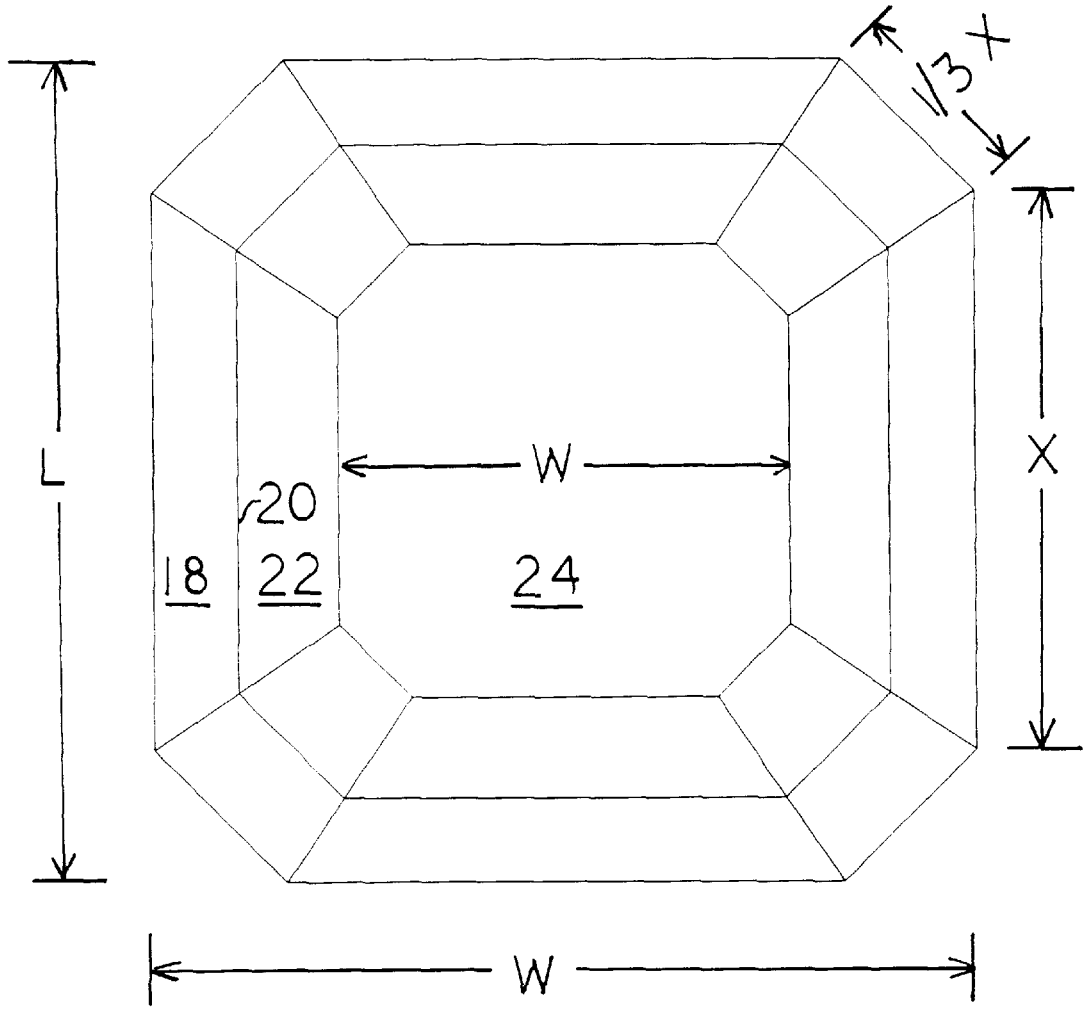
FIG. 2 is a top plan view of the gemstone of FIG. 1.

Another characteristic to define the configuration of the crown is the table percentage, which is a measure of the size of the table relative to the width of the girdle. This is shown in FIG. 2, which shows a top plan view of the crown. Here the crown is shown to be substantially square, having a length L and a width W. In the preferred embodiment, the gemstone is substantially square, meaning that the length L is no more than 110%, and preferably no more than 103%, than the width W. If the stone is not perfectly square, such that the length does not equal the width, the longer side is the length and the shorter side is the width. If the stone is perfectly square, the length and width are equal and interchangeable because they are indistinguishable. The table percentage, which is the width of the table as a percentage of the width of the girdle, in the preferred embodiment is preferably in the range of about 52–58%.

Another characteristic of the crown according to the preferred embodiment is the size of the corner relative to the longest length side. The corner size is about ⅓ of the size of the longest length side as represented by ⅓X and X, shown next to a corner and side, respectively, in FIG. 2. The same relationship of corner size to size of the long length side is also the same in the pavilion.

Figure 3:
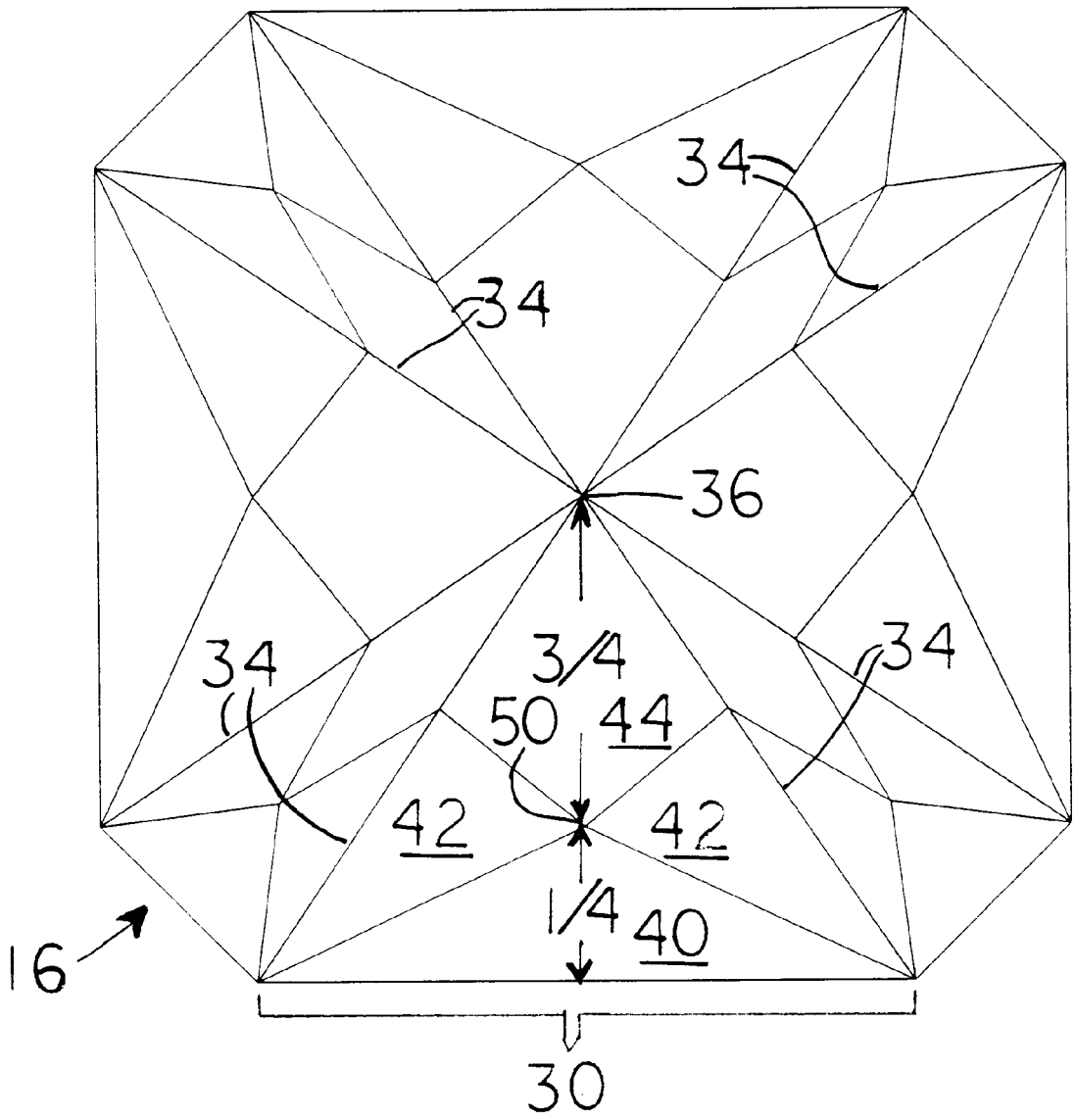
FIG. 3 is a bottom view of the gemstone of FIGS. 1 and 2.
Figure 4:
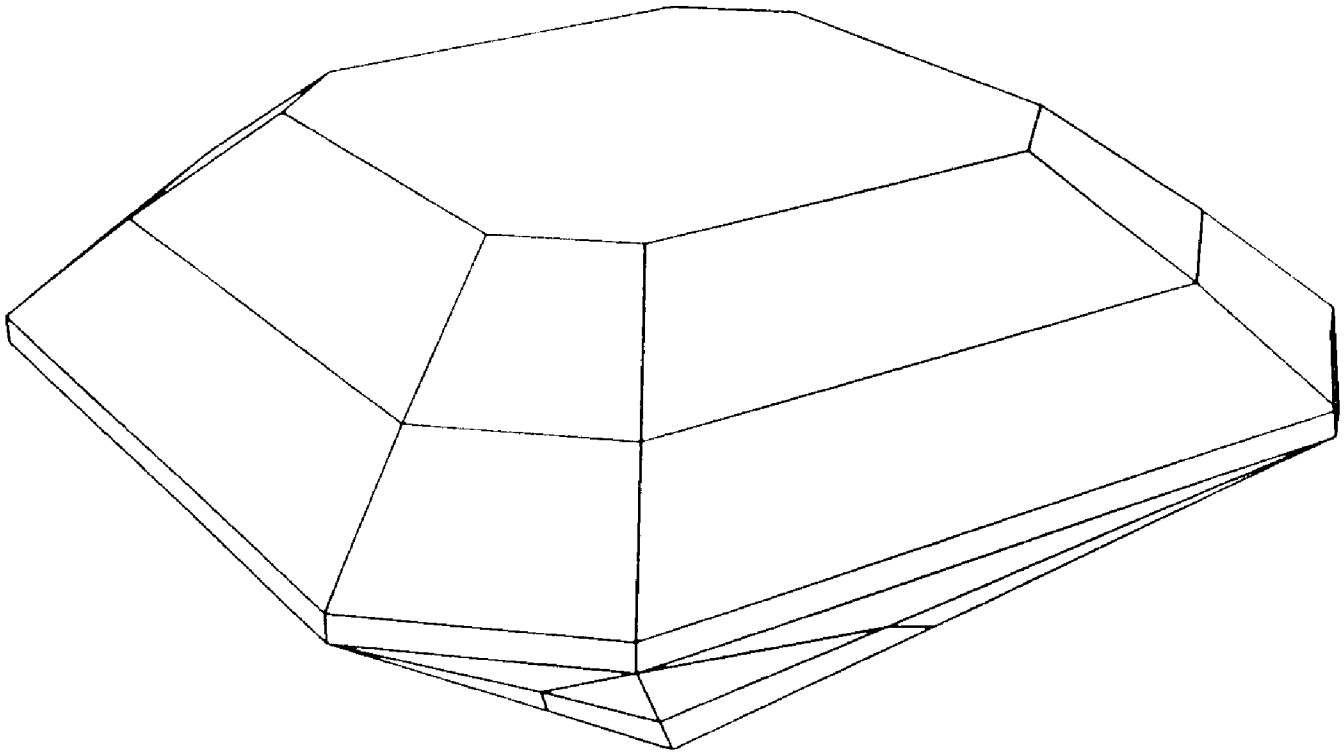
FIG. 4 is a top perspective view of the gemstone of FIGS. 1–3.
Figure 5:
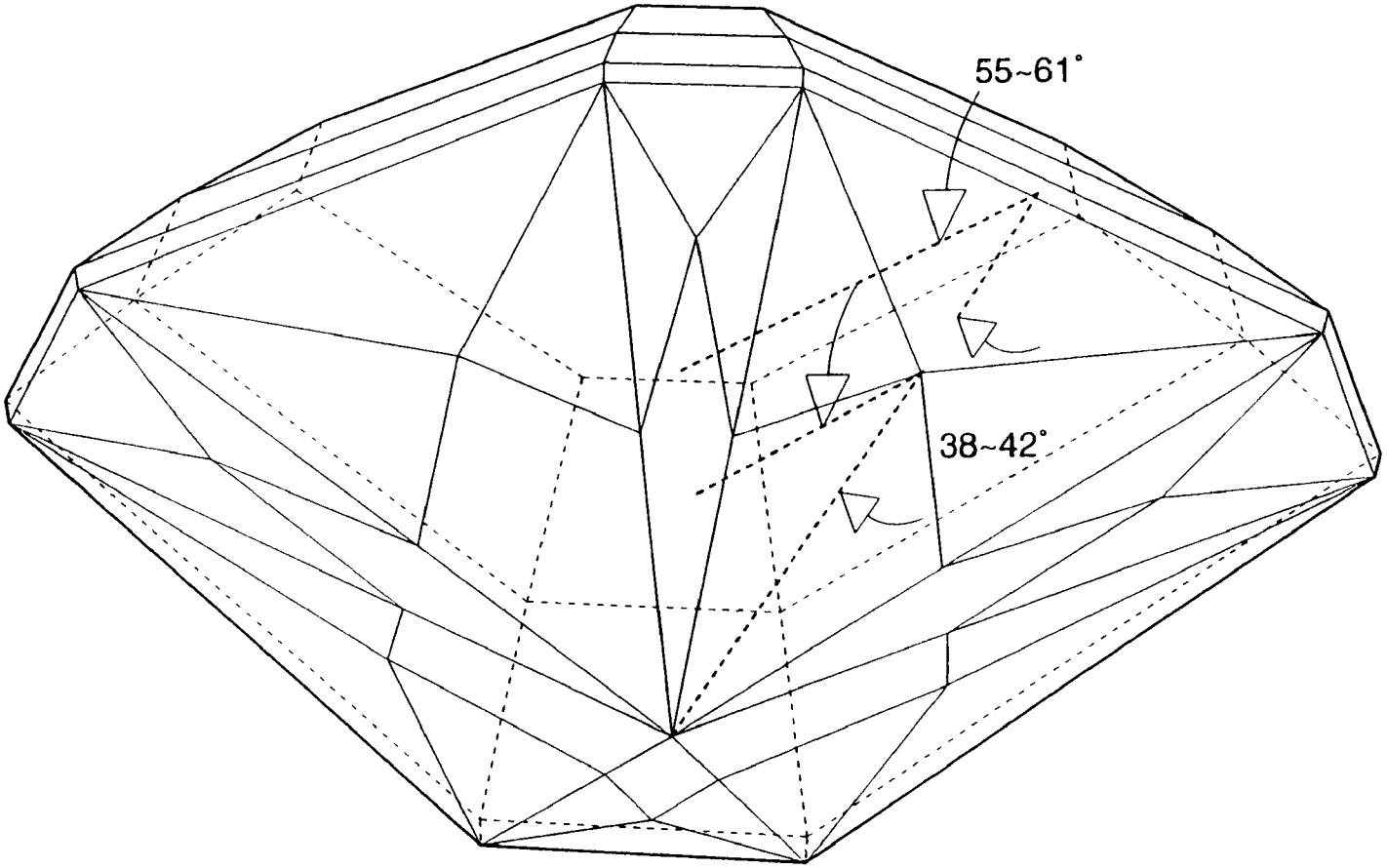
FIG. 5 is a bottom perspective view of the gemstone of FIGS. 1–3.

FIG. 3 shows the pavilion 16 from the bottom view of the gemstone, and reveals that the pavilion 16 is formed of four sides 30 and four corners 32, in the ratio or relative size similar to that just described for the crown. The four sides and four corners are defined by eight rib lines 34. Each rib line 34 extends from the girdle substantially continuously down to a culet 36. Each pavilion side 30 is substantially identical to each other pavilion side, except perhaps for size if the gemstone is not a perfect square having equal length and width. Each pavilion corner 32 is also substantially identical to each other pavilion corner.

Each pavilion side 30 has four facets, including one lower or bottom girdle star 40 having three sides, two lower girdle facets 42 each having three sides, and one lower bezel 44 having four sides. The lower girdle star 40 has one side along the girdle, and two other sides each in common with a different one of the two lower girdle facets 42. The two lower girdle facets 42 each have another side along a different rib line 34, and a third side in common with different sides of the lower bezel 44. The lower bezel 44 has its two remaining sides along the two different rib lines 34. The lower point of the lower bezel 44 is at the culet 36. All four facets of a side have a common intersection point 50. That common intersection point 50 is about ¾ of the way from the culet 36 to the girdle 14, and defines in part the length of the long diagonal of the lower bezel 44. The remaining ¼ between the common intersection point 50 and the girdle 14 defines in part the height of the triangle of the lower girdle star 40. This ¾ to ¼ relationship is shown in the bottom of FIG. 3.

The pavilion corners 32 have four facets similar as that of the pavilion sides.

The lower girdle star 40 is preferrably at an angle of about 55–61 degrees from the girdle plane. Another characteristic of the pavilion 16 is the pavilion angle, which is the angle between a rib line 34 with the girdle plane. In the preferred embodiment, that angle is between about 38–42 degrees, shown as angle c in FIG. 1.

Figure 6:
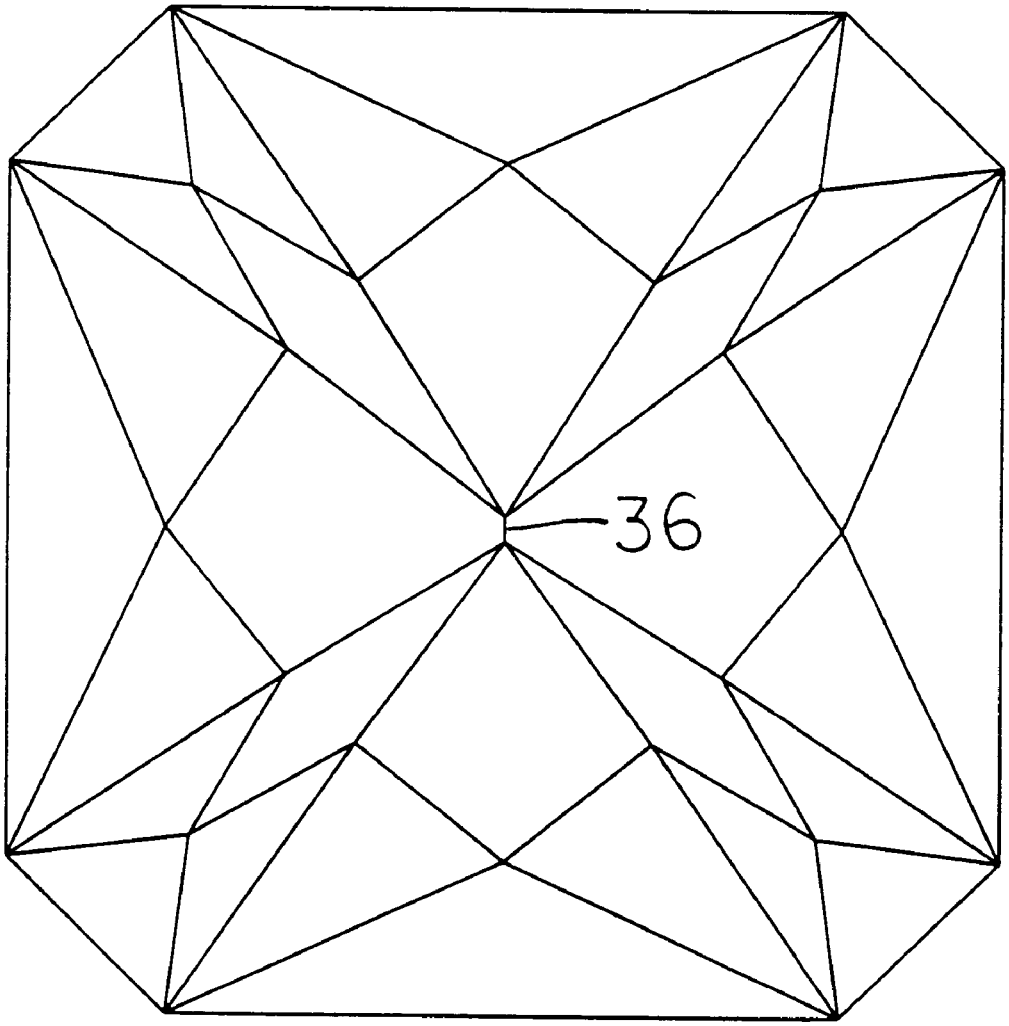
FIG. 6 is a bottom view of the gemstone for a culet in the form of a line.
Figure 7:
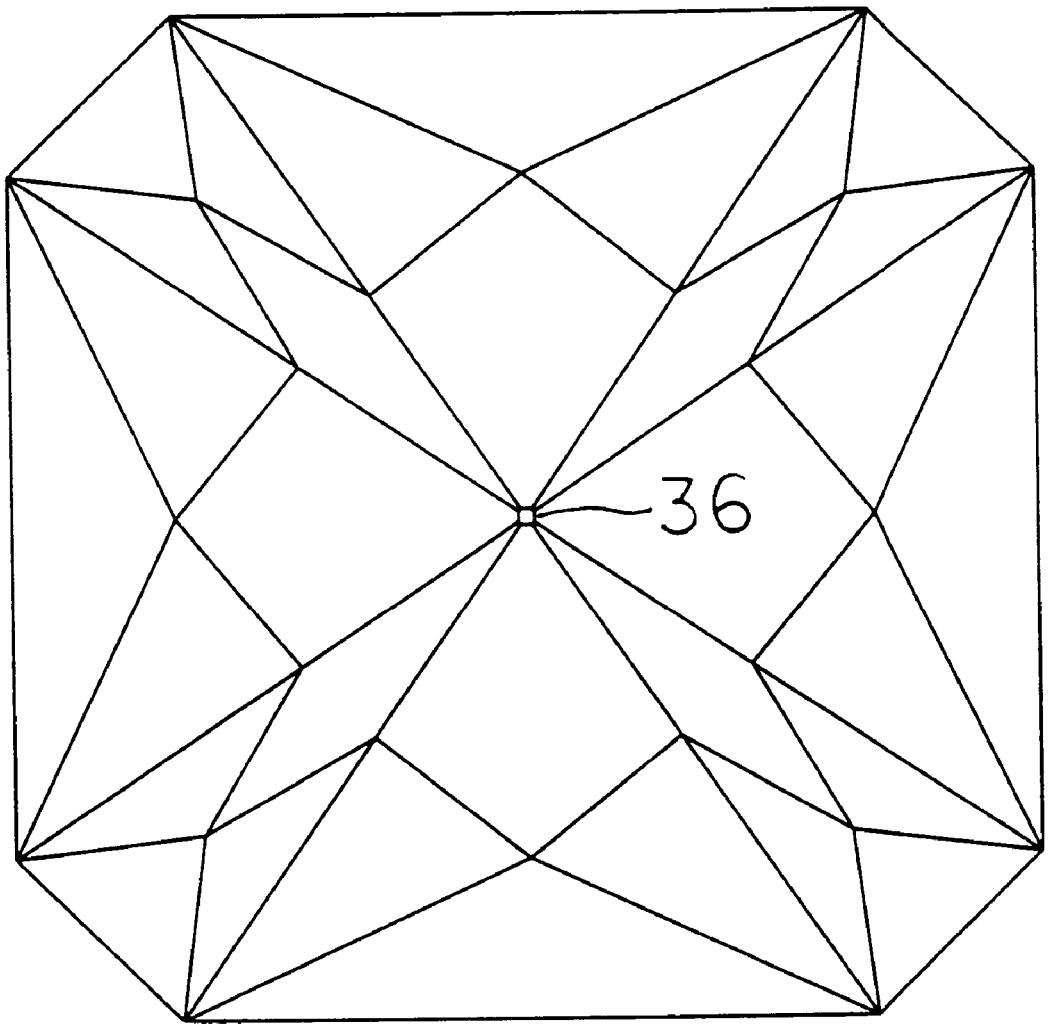
FIG. 7 is a bottom view of the gemstone for a culet in the form of a facet.

The culet 36 is at the intersection of the four side lower bezels 44 and four corner lower bezels 44. The culet 36 can be a point, a line (as shown in FIG. 6) or a facet (as shown in FIG. 7) with some width and length. Another way to describe the culet is that it has a between range "none" and "small", which will be understood to those skilled in the art. "None" means that the culet has no shape, or is simply a point (or substantially a point). "Small" means that the culet, if a line, has a small length relative to the rest of the gemstone, and if a facet, has a small size relative to other facets in the gemstone.

Another characteristic of the overall gemstone is the total depth percentage, which is the ratio of the shortest horizontal displacement (i.e. the width of the girdle) to the longest vertical displacement (or overall height of the stone). In the preferred embodiment, the total depth percentage is in the range of about 65–71%.

In the preferred embodiment, the stone can be any stone, precious, semi-precious or otherwise. Examples of precious stones are diamonds, emeralds, rubies and sapphires. The gemstone of the present invention is believed to have great appeal as a diamond stone mounted to serve as a solitaire diamond engagement ring. Of course, the gemstone can be used in a wedding or other ring with other stones, or for a different article of jewelry such as for a necklace, bracelet or earring either alone or with other similar or different stones.

Although not essential to the preferred embodiment of the present invention, a stone according to the preferred embodiment would preferably have other characteristics such as color (range D–I), clarity (range internally flawless (IF)—very slightly included (VS2), carat weight, fluorescence (none-medium), polish (good-excellent) and symmetry (good-excellent).

Although one preferred embodiment has been shown and described, numerous variations and modifications will occur to those skilled in the art without departing from the spirit and scope of the invention, which is not limited to the preferred embodiment and is defined by way of the appended claims.

I claim:

1. A cut cornered mixed cut gemstone, comprising a girdle, a crown above said girdle and a pavilion below said girdle, said crown comprising a width and length formed by two pairs of opposing crown sides, four crown corners, said crown also comprising at least two steps, including a first step from the girdle to a crown break, and a second step from the crown break to a table break, said crown also having a substantially flat table said pavilion having a bottom and comprising a substantially centrally located culet at the bottom of the pavilion, said pavilion also comprising two pairs of opposing pavilion sides and four pavilion corners defined by eight rib lines extending from the girdle to the culet, each pavilion side and pavilion corner comprising four facets each having a facet corner intersecting at a facet intersection point, said four facets including a lower girdle star facet having one edge along the girdle, two lower girdle facets adjacent said lower girdle star facet and each having a side along an adjacent rib line, and a lower bezel facet adjacent said two lower girdle facets, said lower bezel facet having two sides along adjacent rib lines.

2. The gemstone according to claim 1, wherein the length of the crown is between about 100 to 110% of the width of the crown.

3. The gemstone according to claim 1, wherein the length of the crown is between about 100 to 103% of the width of the crown.

4. The gemstone according to claim 1, wherein the girdle lies substantially in a girdle plane, and wherein the first step of the crown is at an angle of about 41–44 degrees relative to the girdle plane, and wherein the second step is at an angle of about 36–39 degrees relative to the girdle plane.

5. The gemstone according to claim 1, wherein the crown has 17 facets.

6. The gemstone according to claim 1, wherein the pavilion has 32 facets, exclusive of any culet facet.

7. The gemstone according to claim 1, wherein the culet is substantially in the form of a point.

8. The gemstone according to claim 1, wherein the culet is substantially in the form of a line.

9. The gemstone according to claim 1, wherein the culet is substantially in the form of a facet.

10. The gemstone according to claim 1, wherein the length of the crown along the girdle is about three times the length of a crown corner along the girdle.

11. The gemstone according to claim 1, wherein the girdle has a length and width and wherein the pavilion has a pavilion length defined by one of said two pairs of opposing pavilion sides, and a pavilion width defined by the other of said two pairs of opposing pavilion sides adjacent said one of said two pairs of opposing pavilion sides, said pavilion length and pavilion width being further defined by respective dimensions along the length and width of the girdle, and wherein the pavilion length is between about 100 and 110% of the pavilion width.

12. The gemstone according to claim 1, wherein the girdle has a width, and wherein the table has a width and a size defined by its width, said table size being about 52–58% of the width of the crown at the girdle.

13. The gemstone according to claim 1, wherein the girdle has a width, and wherein the gemstone has a total depth of about 65–71% of the width of the girdle.

14. The gemstone according to claim 1, wherein the girdle lies in a girdle plane, and wherein the rib lines in the pavilion are at an angle of about 38–42 degrees relative to the girdle plane.

15. A cut cornered mixed-cut gemstone, comprising a girdle in a girdle plane, a crown above said girdle and a pavilion below said girdle, said crown comprising a width and length formed by two pairs of opposing crown sides and four crown corners, said crown corner having a length along the girdle, said crown also comprising two steps, including a first step from the girdle to a crown break having an angle of about 41–44 degrees relative to the girdle plane, and a second step from the crown break to a table break having an angle of about 36–39 degrees to the girdle plane, wherein the length of the crown is about 100 to 103% of its width and wherein the length of the crown along the girdle is about three times the length of a crown corner along the girdle, said crown also having a substantially flat table, said table having a width and a size defined by its width, said crown having a size defined by its length and width said table size being about 52–58% of the size of the crown at the girdle, and having a total of 17 facets;

said pavilion having a bottom and comprising a substantially centrally located culet at the bottom of the pavilion, said pavilion also comprising two pairs of opposing pavilion sides and four pavilion corners defined by eight rib lines extending from the girdle to the culet, each pavilion side and pavilion corner comprising four facets each having a facet corner intersecting at a facet intersection point, said four facets including a lower girdle star facet having one edge along the girdle, two lower girdle facets adjacent said lower girdle star facet and each having a side along an adjacent rib line, and a lower bezel facet adjacent said two lower girdle facets, said lower bezel facet having two sides along adjacent rib lines, wherein the rib lines in the pavilion are at an angle of about 38–42 degrees relative to the girdle plane, and wherein the pavilion has a pavilion length defined by one of said two pairs of opposing pavilion sides, and a pavilion width defined by the other of said two pairs of opposing pavilion sides adjacent said one of said two pairs of opposing pavilion sides, said girdle having a length and width, said pavilion length and pavilion width being further defined by respective dimensions along the length and width of the girdle, and wherein the pavilion length is between about 100 and 103% of the pavilion width, and wherein the pavilion has a total of 32 facets exclusive of any culet facet, and wherein the gemstone has a total depth of about 65–71% of the width of the girdle.

16. The gemstone according to claim 15, wherein the culet is substantially in the form of a point.

17. The gemstone according to claim 15, wherein the culet is substantially in the form of a line.

18. The gemstone according to claim 15, wherein the culet is substantially in the form of a facet.

* * * * *

US005970744C1

(12) EX PARTE REEXAMINATION CERTIFICATE (9032nd)

United States Patent
Greeff

(10) Number: US 5,970,744 C1
(45) Certificate Issued: May 29, 2012

(54) CUT CORNERED SQUARE MIXED-CUT GEMSTONE

(75) Inventor: Robert S. Greeff, Norwalk, CT (US)

(73) Assignee: Tiffany and Company, New York, NY (US)

Reexamination Request:
No. 90/006,725, Jul. 24, 2003

Reexamination Certificate for:

| | |
|---|---|
| Patent No.: | **5,970,744** |
| Issued: | **Oct. 26, 1999** |
| Appl. No.: | **09/203,118** |
| Filed: | **Dec. 1, 1998** |

(51) Int. Cl.
*A44C 17/00* (2006.01)

(52) U.S. Cl. ..... 63/32
(58) Field of Classification Search ..... None
See application file for complete search history.

(56) References Cited

To view the complete listing of prior art documents cited during the proceeding for Reexamination Control Number 90/006,725, please refer to the USPTO's public Patent Application Information Retrieval (PAIR) system under the Display References tab.

*Primary Examiner*—Jack W. Lavinder

(57) ABSTRACT

A cut cornered mixed-cut square gemstone comprises a step-cut crown, with two steps and a table, a girdle and a pavilion. The crown and pavilion are substantially square with four equal sides, and corners about ⅓ the length of the sides. The pavilion sides and corners are defined by eight rib lines which extend substantially continuously from the girdle to a culet. Each pavilion side and corner has four facets, including a lower girdle star facet, two lower girdle facets and a lower bezel facet. The gemstone has the classic elegance of a step cut in the crown and attempts to achieve the good dispersion of a brilliant cut in the pavilion.

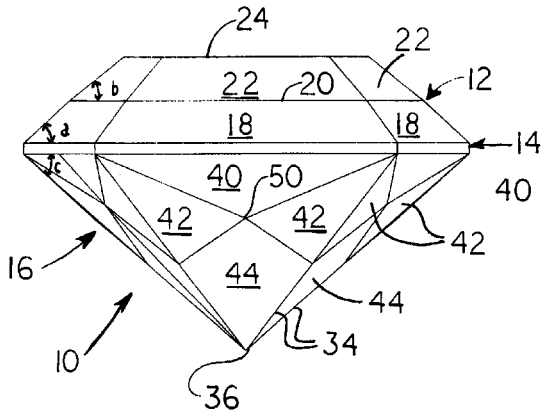

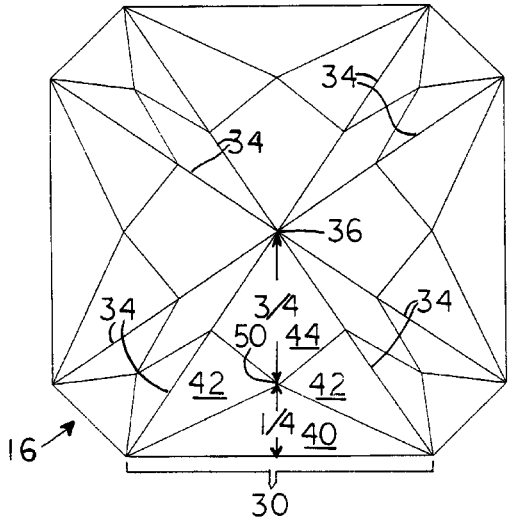

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-18 are cancelled.

* * * * *